US011661294B2

(12) United States Patent
Waki et al.

(10) Patent No.: US 11,661,294 B2
(45) Date of Patent: May 30, 2023

(54) RECORDING DEVICE

(71) Applicant: SEIKO EPSON CORPORATION, Tokyo (JP)

(72) Inventors: Shingo Waki, Matsumoto (JP); Yuki Komatsu, Shiojiri (JP); Kenji Oshima, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 91 days.

(21) Appl. No.: 17/082,630

(22) Filed: Oct. 28, 2020

(65) Prior Publication Data

US 2021/0130120 A1 May 6, 2021

(30) Foreign Application Priority Data

Oct. 30, 2019 (JP) ..... JP2019-197264

(51) Int. Cl.

| | |
|---|---|
| ***B41J 2/01*** | (2006.01) |
| ***B65H 5/06*** | (2006.01) |
| ***B65H 85/00*** | (2006.01) |
| ***B41J 11/00*** | (2006.01) |
| *B41J 3/60* | (2006.01) |

(52) U.S. Cl.

CPC ..... *B65H 5/062* (2013.01); *B41J 11/0045* (2013.01); *B65H 85/00* (2013.01); *B41J 3/60* (2013.01); *B65H 2801/06* (2013.01)

(58) Field of Classification Search

None

See application file for complete search history.

(56) References Cited

U.S. PATENT DOCUMENTS

2007/0222846 A1* 9/2007 Nakamura ..... B65H 85/00 347/104
2015/0274477 A1* 10/2015 Kodama ..... B65H 5/062 271/3.19
2019/0300319 A1* 10/2019 Ohashi ..... B65H 29/242

FOREIGN PATENT DOCUMENTS

JP 2005074746 A * 3/2005 ..... B41J 11/0095
JP 2018-197167 12/2018

* cited by examiner

*Primary Examiner* — Erica S Lin
*Assistant Examiner* — Tracey M McMillion
(74) *Attorney, Agent, or Firm* — Workman Nydegger

(57) ABSTRACT

A recording device includes a first transportation path along which a medium is transported, a recording unit configured to record on the medium on the first transportation path, a second transportation path branching from the first transportation path, a flap located at the junction and configured to be moved to a first position to open the first transportation path and to a second position to close the first transportation path, and a driving section. After the medium passes the junction, the flap is positioned at the second position to come in contact with the medium traveling upstream along the first transportation path and guide the medium to the second transportation path. The flap is moved to the first position by a driving force of the driving section.

12 Claims, 6 Drawing Sheets

RECORDING DEVICE

The present application is based on, and claims priority from JP Application Serial Number 2019-197264, filed Oct. 30, 2019, the disclosure of which is hereby incorporated by reference herein in its entirety.

BACKGROUND

1. Technical Field

The present disclosure relates to a recording device.

2. Related Art

JP-A-2018-197167 describes an image recording device as an example of a recording device. The image recording device includes a first transportation path along which a medium is transported, a second transportation path branching from the first transportation path, a recording unit that records on a medium on the first transportation path, and a flap located at a junction of the first transportation path and the second transportation path. In the image recording device, a medium travels along the second transportation path when double-sided recording is performed. A medium printed on one side travels along the second transportation path to return to the first transportation path. After the medium returns to the first transportation path, the recording unit records again on the medium.

The flap is movable to a first position to open the first transportation path and to a second position to close the first transportation path. The flap is pushed toward the second position by a coil spring. The flap at the second position is moved to the first position when pushed by a medium traveling downstream along the first transportation path. However, the flap is not moved from the second position when pushed by a medium traveling upstream along the first transportation path. Thus, the flap guides the medium to the second transportation path.

In the image recording device described in JP-A-2018-197167, a low-rigidity medium may be transported. In such a case, the low-rigidity medium traveling downstream along the first transportation path does not push the flap with enough force to move the flap at the second position to the first position in some cases. Thus, the medium may be stuck on the first transportation path.

SUMMARY

To solve the above-described problem, a recording device includes a first transportation path along which a medium is transported, a recording unit configured to record on the medium on the first transportation path, a second transportation path branching from the first transportation path, a flap located at a junction of the first transportation path and the second transportation path and configured to be moved to a first position to open the first transportation path and to a second position to close the first transportation path, and a driving section. After the medium passes the junction, the flap is positioned at the second position to come in contact with the medium traveling upstream along the first transportation path and guide the medium to the second transportation path. The flap is moved to the first position by a driving force of the driving section.

DESCRIPTION OF EXEMPLARY EMBODIMENTS

Hereinafter, an embodiment of a recording device is described with reference to the drawings. The recording device is, for example, an ink jet printer that ejects an ink, which is an example of a liquid, onto a medium, such as a sheet of paper, to record an image including characters and photographs.

Figure 1:
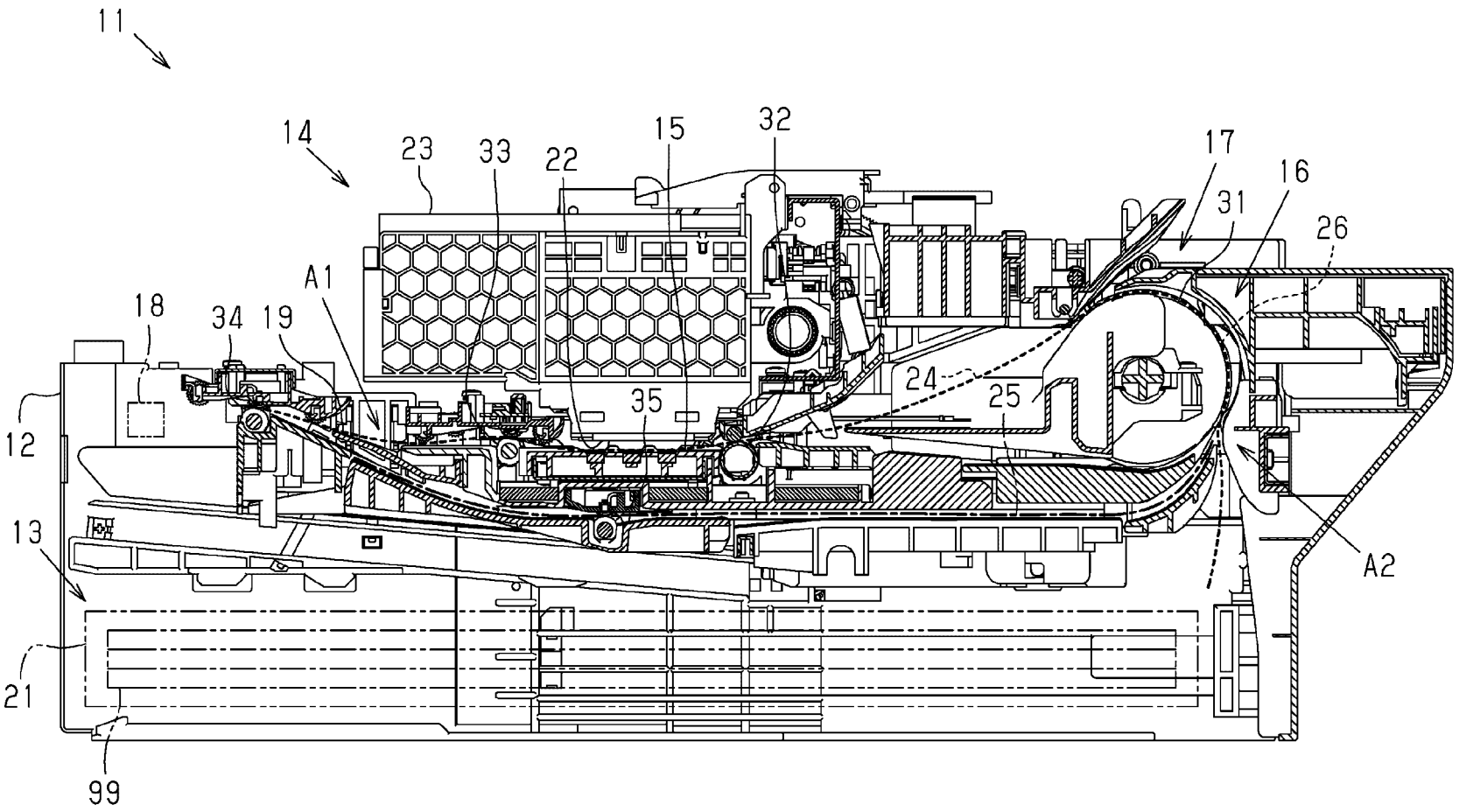
FIG. 1 is a cross-sectional view illustrating an example of a recording device.

As illustrated in FIG. 1, a recording device 11 includes a casing 12 and a housing 13. The recording device 11 includes a recording unit 14, a support 15, a transportation path 16, a transportation unit 17, a driving section 18, and a flap 19.

The housing 13 accommodates a medium 99. The housing 13 of this embodiment houses a cassette 21 that accommodates the medium 99. The cassette 21 is detachable from the casing 12. The cassette 21 is in the housing 13 when attached to the casing 12. The housing 13 accommodates the medium 99 when housing the cassette 21. In the recording device 11, the medium 99 in the housing 13 is feedable to the recording unit 14.

The recording unit 14 records on the medium 99. The recording unit 14 includes, for example, a head 22 and a carriage 23. The head 22 ejects a liquid toward the medium 99. The carriage 23 on which the head 22 is mounted scans the medium 99. In other words, the recording device 11 of this embodiment is a serial printer. The recording device 11 may be a line printer that records one entire row on the medium 99 at one time. The recording unit 14 of this embodiment records on the medium 99 from above.

The support 15 faces the recording unit 14. The support 15 supports the medium 99 sent from the housing 13. The support 15 supports a portion of the medium 99 to be recorded by the recording unit 14. The support 15 of this embodiment supports the medium 99 from below.

The transportation path 16 is a route along which the medium 99 is transported. The transportation path 16 includes a first transportation path 24 and a second transportation path 25. In FIG. 1, the first transportation path 24 is indicated by a broken line and the second transportation path 25 is indicated by a one-dot chain line.

The first transportation path 24 extends from the housing 13 and passes the recording unit 14. The first transportation path 24 of this embodiment extends through a space between the recording unit 14 and the support 15. Thus, recording is performed on the medium 99 by the recording unit 14 while the medium 99 is transported along the first transportation path 24. In other words, the recording unit 14 records on the medium 99 traveling along the first transportation path 24. The recorded medium 99 is transported along the first transportation path 24 and ejected to the outside of the casing 12.

The first transportation path 24 of this embodiment extends upward from the housing 13 and then extends forward toward the recording unit 14. In this configuration, the first transportation path 24 of this embodiment includes a curved portion 26 that curves. The curved portion 26 of the first transportation path 24 is positioned between the housing 13 and the recording unit 14. The orientation of the medium 99 is inverted upside down by being transported along the curved portion 26 such that the surface of the medium 99 facing up in the housing 13 and the surface of the medium 99 facing the recording unit 14 are opposite surfaces.

The second transportation path 25 branches from the first transportation path 24. The second transportation path 25 of this embodiment branches from the first transportation path 24 at a position downstream of the recording unit 14. In other words, a junction A1 of the first transportation path 24 and the second transportation path 25 is located downstream of the recording unit 14 on the first transportation path 24.

The second transportation path 25 meets the first transportation path 24 at a position away from the junction A1. The second transportation path 25 of this embodiment meets the first transportation path 24 at a position upstream of the recording unit 14. In other words, a meeting point A2 where the first transportation path 24 and the second transportation path 25 meet is located upstream of the recording unit 14 on the first transportation path 24. More specifically described, the meeting point A2 is located upstream of the curved portion 26 on the first transportation path 24.

The second transportation path 25 extends from the junction A1 to the meeting point A2. The second transportation path 25 of this embodiment is located below the first transportation path 24. The medium 99 is transported along the second transportation path 25 when double-sided recording is performed.

The transportation unit 17 transports the medium 99 along the transportation path 16. The transportation unit 17 includes, for example, multiple rollers. The transportation unit 17 of this embodiment includes a first transportation roller 31, a second transportation roller 32, a first discharge roller 33, a second discharge roller 34, and a relay roller 35. The first transportation roller 31, the second transportation roller 32, the first discharge roller 33, the second discharge roller 34, and the relay roller 35 rotate to send the medium 99.

The first and second transportation rollers 31 and 32 and the first and second discharge rollers 33 and 34 are located along the first transportation path 24. The first transportation roller 31, the second transportation roller 32, the first discharge roller 33, and the second discharge roller 34 are located in this order from upstream to downstream of the first transportation path 24.

The first transportation roller 31 is located upstream of the recording unit 14 on the first transportation path 24. More specifically described, the first transportation roller 31 is located between the recording unit 14 and the meeting point A2 on the first transportation path 24. The first transportation roller 31 sends the medium 99 that has been sent from the housing 13 and the medium 99 that has been transported along the second transportation path 25. The first transportation roller 31 has an outer surface extending along the curved portion 26 of the first transportation path 24. Thus, a portion of the first transportation path 24 extending along the outer surface of the first transportation roller 31 is the curved portion 26.

The second transportation roller 32 is located upstream of the recording unit 14 on the first transportation path 24. The second transportation roller 32 is located between the recording unit 14 and the first transportation roller 31 on the first transportation path 24. The second transportation roller 32 sends the medium 99 that has been sent by the first transportation roller 31. The second transportation roller 32 of this embodiment comes in contact with the medium 99 from below.

The first discharge roller 33 is located downstream of the recording unit 14 on the first transportation path 24. More specifically described, the first discharge roller 33 is located between the recording unit 14 and the junction A1 on the first transportation path 24. The first discharge roller 33 sends the medium 99 that has been sent by the second transportation roller 32. The first discharge roller 33 of this embodiment comes in contact with the medium 99 from below.

The second discharge roller 34 is located downstream of the recording unit 14 on the first transportation path 24. More specifically described, the second discharge roller 34 is located downstream of the junction A1 on the first transportation path 24. The second discharge roller 34 sends the medium 99 that has been sent by the first discharge roller 33. The second discharge roller 34 of this embodiment comes in contact with the medium 99 from below.

The second discharge roller 34 rotates both in a positive direction and a negative direction. The second discharge roller 34 rotates in the positive direction to send the medium 99 downstream along the first transportation path 24. The second discharge roller 34 rotates in the negative direction, which is a direction opposite the positive direction, to send the medium 99 upstream along the first transportation path 24. In FIG. 1, the positive direction corresponds to a counterclockwise direction and the negative direction corresponds to a clockwise direction.

The relay roller 35 is located along the second transportation path 25. Thus, the relay roller 35 sends the medium 99 along the second transportation path 25. The relay roller 35 sends the medium 99 from the junction A1 toward the meeting point A2 along the second transportation path 25. The relay roller 35 of this embodiment comes in contact with the medium 99 from below.

The driving section 18 is a motor, for example. The driving section 18 of this embodiment is coupled to the second discharge roller 34. Thus, the second discharge roller 34 is rotated by the driving force of the driving section 18.

Figure 2:
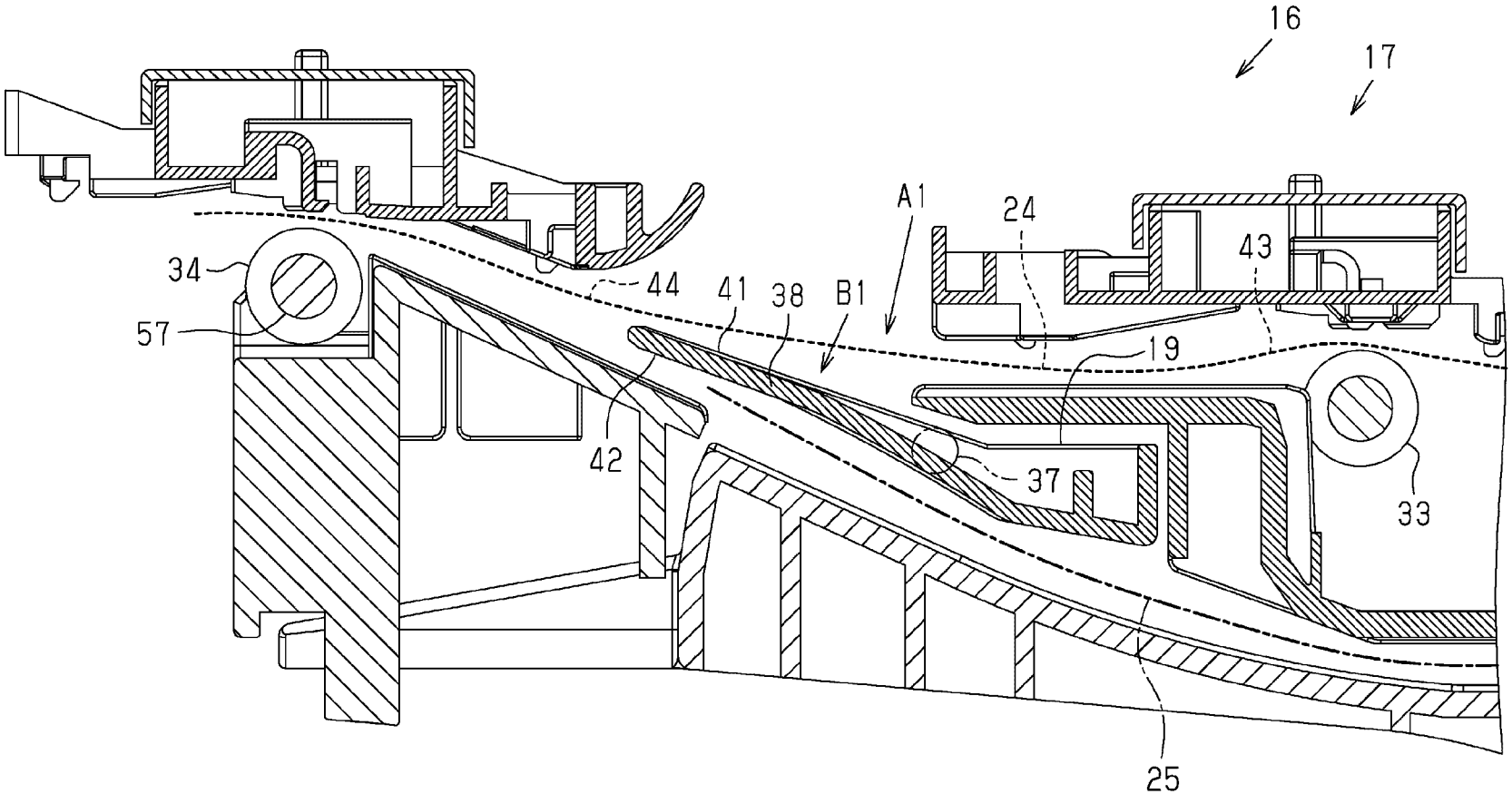
FIG. 2 is a cross-sectional view illustrating a flap at a first position.
Figure 3:
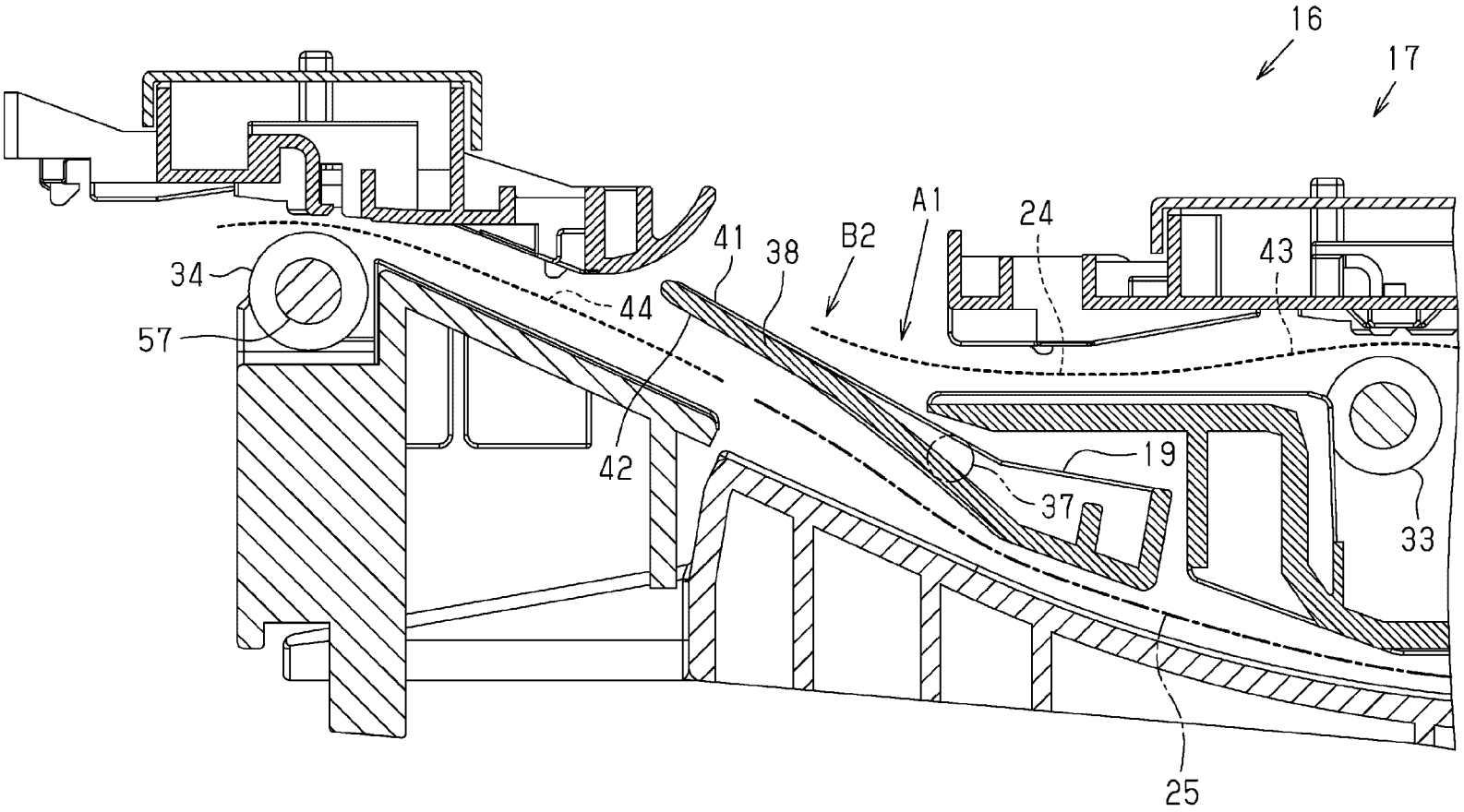
FIG. 3 is a cross-sectional view illustrating the flap at a second position.

As illustrated in FIGS. 2 and 3, the flap 19 is located at the junction A1. At the junction A1, the flap 19 guides the medium 99 traveling along the transportation path 16. The flap 19 switches the destination of the medium 99 at the junction A1.

The flap 19 includes a rotation shaft 37. The flap 19 rotates about the rotation shaft 37. The rotation shaft 37 is located, for example, between the first transportation path 24 and the second transportation path 25. In this embodiment, the rotation shaft 37 is located between the first transportation path 24 and the second transportation path 25 in the vertical direction.

The flap 19 has a protruded portion 38. The protruded portion 38 of the flap 19 extends from the rotation shaft 37 toward the junction A1. The protruded portion 38 is a portion of the flap 19 located at the junction A1. The protruded portion 38 comes in contact with the medium 99 traveling along the transportation path 16. The flap 19 comes in contact with the medium 99 at the protruded portion 38 to guide the medium 99 at the junction A1.

The protruded portion 38 has a first surface 41 and a second surface 42. The first surface 41 of the protruded portion 38 is a surface opposite the second surface 42. In this embodiment, the first surface 41 of the protruded portion 38 faces up. In this embodiment, the second surface 42 of the protruded portion 38 faces down.

The flap 19 is movable to a first position B1 and to a second position B2. The flap 19 of this embodiment turns about the rotation shaft 37 to the first position B1 or the second position B2.

As illustrated in FIG. 2, the first position B1 is a position for opening the first transportation path 24. When the flap 19 is positioned at the first position B1, the protruded portion 38 is positioned along the first transportation path 24. When the flap 19 is positioned at the first position B1, the first surface 41 extends along the first transportation path 24. Thus, when the flap 19 is positioned at the first position B1, an upstream section 43 of the first transportation path 24, which is located upstream of the junction A1, and a downstream section 44 of the first transportation path 24, which is located downstream of the junction A1, are joined together at the junction A1. This allows the flap 19 at the first position B1 to guide the medium 99 traveling downstream along the upstream section 43 to the downstream section 44.

As illustrated in FIG. 3, the second position B2 is a position for closing the first transportation path 24. When the flap 19 is positioned at the second position B2, the protruded portion 38 crosses the first transportation path 24. Thus, the first transportation path 24 is closed at the junction A1. The upstream section 43 and the downstream section 44 are disconnected at the junction A1.

When the flap 19 is positioned at the second position B2, the downstream section 44 and the second transportation path 25 are joined together at the junction A1. This allows the flap 19 at the second position B2 to come in contact with the medium 99 traveling upstream along the first transportation path 24 and guide the medium 99 to the second transportation path 25. The second position B2 may be referred to as a position for opening the second transportation path 25.

In this embodiment, the front end of the protruded portion 38 of the flap 19 positioned at the second position B2 is positioned above the front end of the protruded position of the flap 19 positioned at the first position B1. In other words, the flap 19 is moved up when the flap 19 is moved to the second position B2, and the flap 19 is moved down when the flap 19 is moved to the first position B1.

Figure 4:
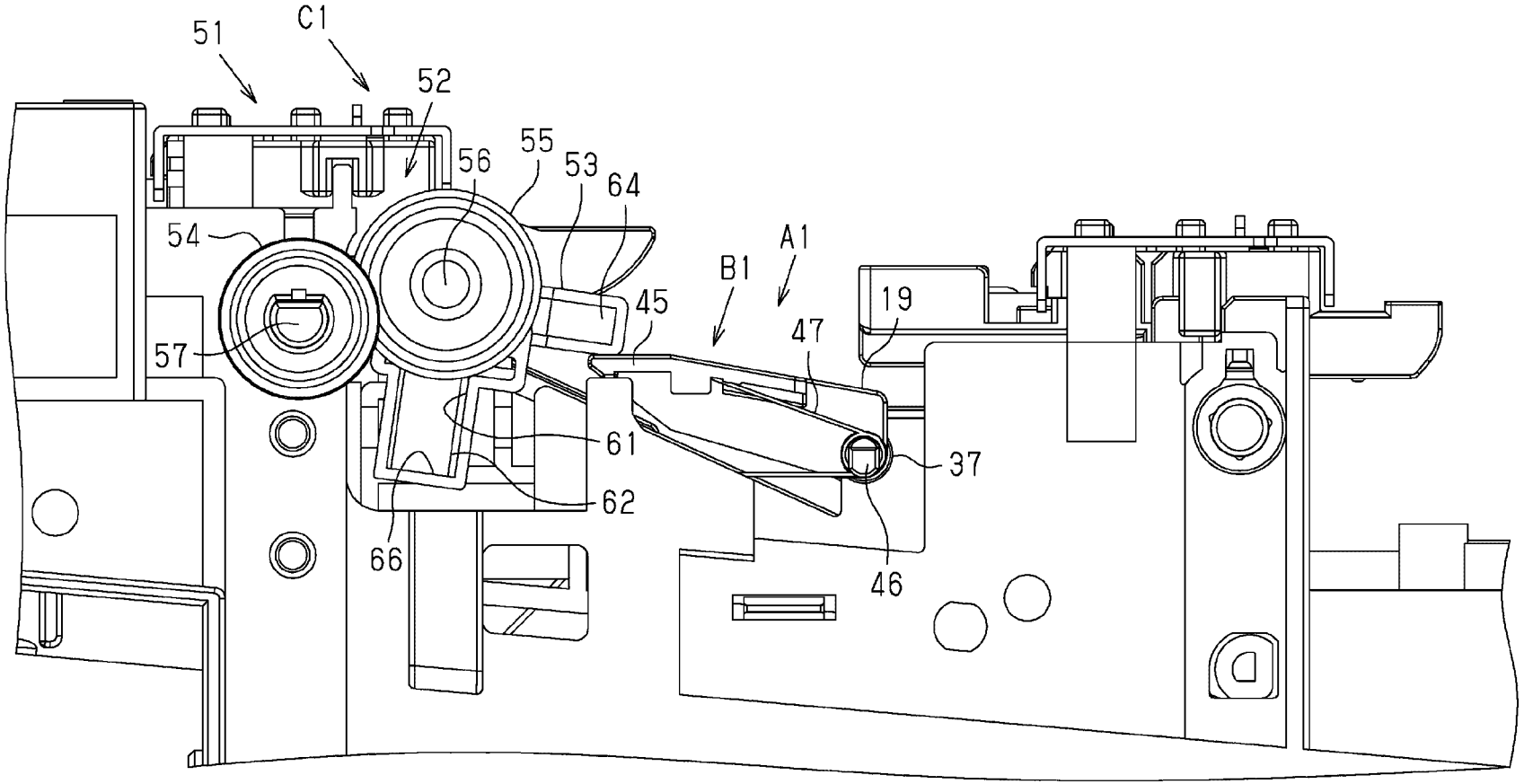
FIG. 4 is a side view illustrating a displacement member at a pushing position.
Figure 5:
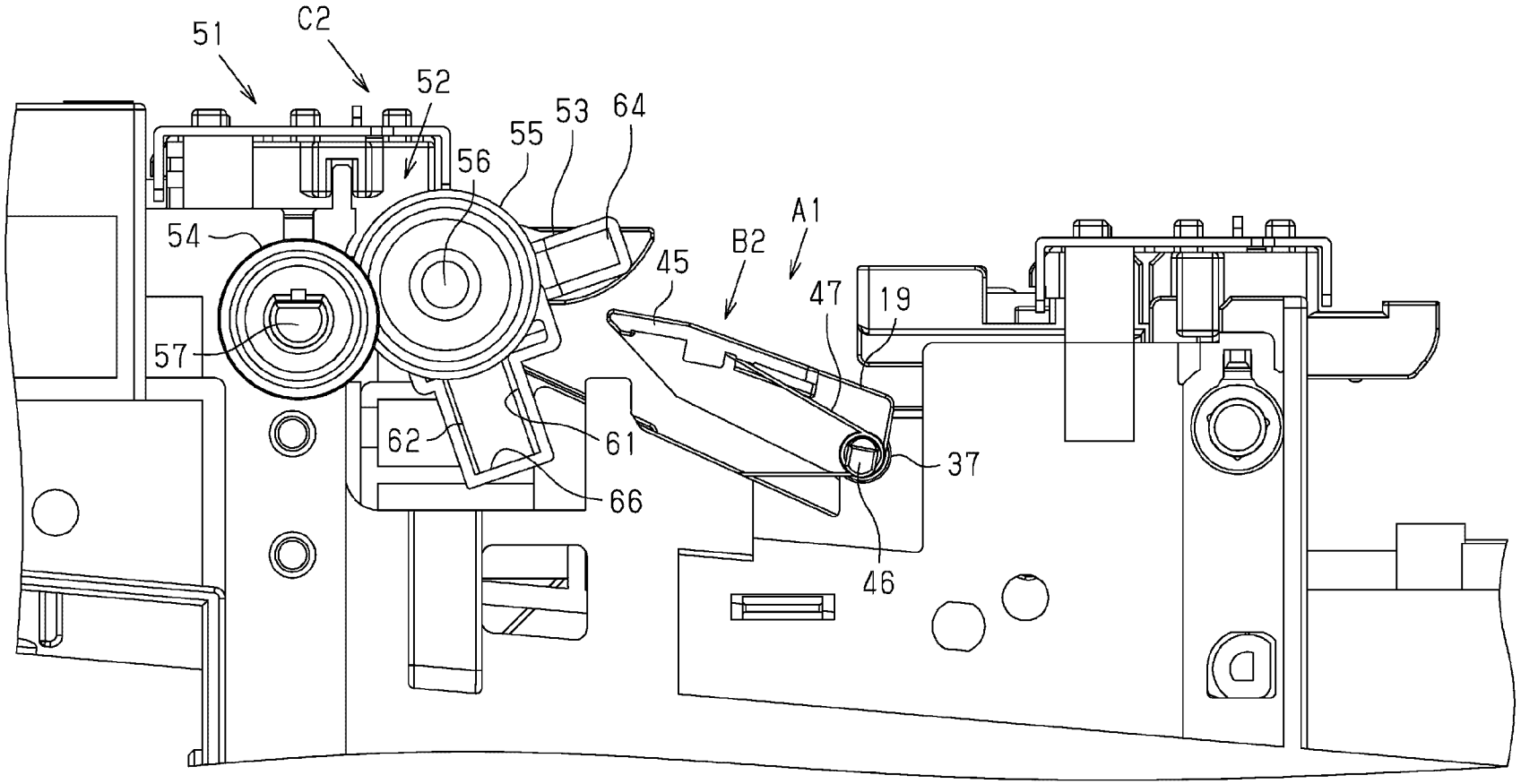
FIG. 5 is a side view illustrating the displacement member at a retracted position.

As illustrated in FIGS. 4 and 5, the flap 19 includes a contact portion 45. In this embodiment, the contact portion 45 is located at an end of the flap 19 in the axial direction of the rotation shaft 37.

The contact portion 45 has an attachment portion 46. In this embodiment, the attachment portion 46 of the flap 19 is coaxial with the rotation shaft 37. The recording device 11 includes a spring 47. The spring 47 may be a torsion spring or another spring. The spring 47 is attached to the attachment portion 46. The spring 47 is in contact with the flap 19 at one end. In this embodiment, the spring 47 is in contact with the contact portion 45 at one end. The spring 47 is in contact with a component supporting the flap 19 at the other end. This enables the spring 47 to apply a force to the flap 19.

The spring 47 pushes the flap 19 toward the second position B2. In other words, the spring 47 applies a force to the flap 19 to move the flap 19 toward the second position B2. The spring 47 of this embodiment pushes the flap 19 up.

The recording device 11 includes a displacement mechanism 51. The displacement mechanism 51 moves the flap 19. The displacement mechanism 51 of this embodiment moves the flap 19 to the first position B1. The displacement mechanism 51 includes, for example, a transmission mechanism 52 and a displacement member 53.

The transmission mechanism 52 transmits a driving force of the driving section 18 to the displacement member 53. The transmission mechanism 52 of this embodiment includes a first gear 54, a second gear 55, and a support shaft 56. The first gear 54 is disposed on the shaft 57 of the second discharge roller 34. The first gear 54 rotates together with the shaft 57. Thus, the first gear 54 is rotated by rotation of the second discharge roller 34. In this embodiment, the first gear 54 is disposed on an end portion of the shaft 57.

The second gear 55 is meshed with the first gear 54. Thus, the second gear 55 is rotated by rotation of the first gear 54. The second gear 55 is disposed on the support shaft 56. In this embodiment, the second gear 55 is located between the first gear 54 and the flap 19 when viewed in the axial direction of the rotation shaft 37.

The support shaft 56 supports the second gear 55 and the displacement member 53. The support shaft 56 extends parallel to the shaft 57. The support shaft 56 is rotated by rotation of the second gear 55. In other words, the support shaft 56 rotates together with the second gear 55. In this way, the support shaft 56 is rotated by the driving force of the driving section 18. The driving force of the driving section 18 is transmitted to the displacement member 53 through rotation of the support shaft 56.

Figure 6:
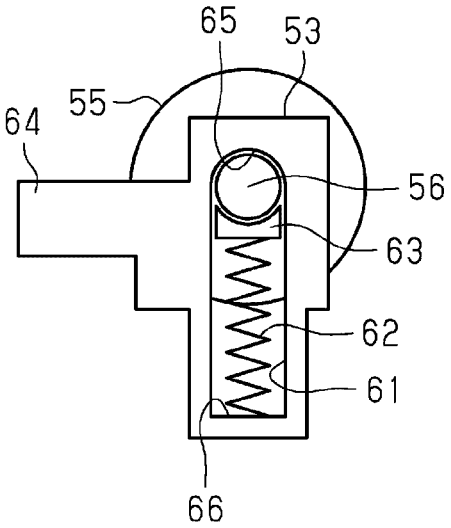
FIG. 6 is a side view schematically illustrating the displacement member.

As illustrated in FIG. 6, the displacement member 53 includes a shaft hole 61, a coil spring 62, a bearing 63, and an arm 64. The shaft hole 61 is a hole receiving the support shaft 56. The inner surface of the shaft hole 61 has a bearing surface 65 and a supporting surface 66. The bearing surface 65 and the supporting surface 66 as the inner surfaces of the shaft hole 61 face each other. The bearing surface 65 is in contact with the support shaft 56. The supporting surface 66 is in contact with the coil spring 62.

The coil spring 62 is in the shaft hole 61. The coil spring 62 is attached to the supporting surface 66 at one end. The coil spring 62 is attached to the bearing 63 at the other end. The bearing 63 is in the shaft hole 61. The bearing 63 is pushed toward the support shaft 56 by the coil spring 62. Thus, the bearing 63 is in contact with the support shaft 56. In other words, the displacement member 53 is fastened to the support shaft 56 by the bearing surface 65 and the bearing 63 sandwiching the support shaft 56.

When the support shaft 56 rotates, the displacement member 53 rotates due to a friction force of the bearing 63 and the bearing surface 65 acting on the support shaft 56. In other words, the displacement member 53 is moved by a driving force of the driving section 18. In this embodiment, when the second discharge roller 34 rotates in the positive direction, the displacement member 53 rotates in the negative direction. When the second discharge roller 34 rotates in the negative direction, the displacement member 53 rotates in the positive direction. In this way, the displacement member 53 is moved together with the second discharge roller 34.

When the torque acting on the displacement member 53 is larger than the friction force of the bearing 63 and the bearing surface 65 acting on the support shaft 56, the bearing 63 and the bearing surface 65 slip on the support shaft 56. This reduces a load applied to the displacement member 53.

As illustrated in FIGS. 4 and 5, the arm 64 extends toward the flap 19. In this embodiment, the arm 64 extends toward a position above the contact portion 45. The front end of the arm 64 overlaps the contact portion 45 in the vertical direction. This allows the arm 64 to come in contact with the contact portion 45 when the displacement member 53 is moved.

The displacement member 53 is movable to a pushing position C1 and to a retracted position C2. The displacement member 53 of this embodiment is moved to the pushing position C1 and to the retracted position C2 by rotation of the support shaft 56.

The pushing position C1 is where the displacement member 53 pushes the flap 19. The displacement member 53 at the pushing position C1 is in contact with the flap 19. When the displacement member 53 is positioned at the pushing position C1, the arm 64 is in contact with the contact portion 45.

When the displacement member 53 is positioned at the pushing position C1, the displacement member 53 pushes the flap 19 toward the first position B1. In this embodiment, the displacement member 53 pushes the flap 19 down when positioned at the pushing position C1. In other words, when the displacement member 53 is positioned at the pushing position C1, the arm 64 pushes the contact portion 45 down. At this time, the flap 19 pushed by the displacement member 53 moves to the first position B1 against the force of the spring 47. In this way, the flap 19 is pushed by the displacement member 53 to the first position B1. In other words, the flap 19 is moved to the first position B1 by the driving force of the driving section 18.

The retracted position C2 is where the displacement member 53 is positioned away from the flap 19. The displacement member 53 at the retracted position C2 does not push the flap 19. In this embodiment, the displacement member 53 is not in contact with the flap 19 when positioned at the retracted position C2. In other words, when the displacement member 53 is positioned at the retracted position C2, the arm 64 is not in contact with the contact portion 45. Thus, when the displacement member 53 is positioned at the retracted position C2, the flap 19 is moved to the second position B2 by the force of the spring 47.

In this embodiment, the displacement member 53 is moved to the pushing position C1 when rotated in the negative direction. Thus, when the second discharge roller 34 is rotated in the positive direction, the displacement member 53 is moved to the pushing position C1. This moves the flap 19 to the first position B1. In this way, when the driving section 18 rotates the second discharge roller 34 to send the medium 99 downstream along the first transportation path 24, the displacement member 53 is moved by the driving force of the driving section 18 to push the flap 19 toward the first position B1.

The displacement member 53 is moved to the retracted position C2 when rotated in the positive direction. Thus, when the second discharge roller 34 is rotated in the negative direction, the displacement member 53 is moved to the retracted position C2. This moves the flap 19 to the second position B2. In this way, when the driving section 18 rotates the second discharge roller 34 to send the medium 99 upstream along the first transportation path 24, the displacement member 53 is moved away from the flap 19 by the driving force of the driving section 18. As described above, the flap 19 is moved to the first position B1 or to the second position B2 depending on the rotation direction of the second discharge roller 34.

When the medium 99 is transported downstream along the first transportation path 24, the first transportation roller 31, the second transportation roller 32, the first discharge roller 33, and the second discharge roller 34 are rotated in the positive direction. At this time, since the second discharge roller 34 is rotated in the positive direction, the flap 19 is moved to the first position B1. Thus, the medium 99 is guided along the first transportation path 24 from the upstream section 43 to the downstream section 44.

When recording is performed on both sides of the medium 99, the medium 99 recorded on one side is transported to the second transportation path 25. Thus, the second discharge roller 34 starts to rotate in the negative direction when the medium 99 recorded on one side reaches the downstream section 44. At this time, since the second discharge roller 34 rotates in the negative direction, the flap 19 is moved to the second position B2. Thus, the medium 99 traveling upstream along the downstream section 44 is guided from the downstream section 44 to the second transportation path 25.

The medium 99 travels through the second transportation path 25 to return to the first transportation path 24. When the medium 99 is transported again along the first transportation path 24, the medium 99 is fed to the recording unit 14 with the surface opposite the recorded surface facing the recording unit 14. In this way, the recording is performed on both sides of the medium 99.

Next, effects and advantages of the embodiment are described.

(1) The flap 19 is moved to the first position B1 by a driving force of the driving section 18. In this configuration, when the medium 99 travels downstream along the first transportation path 24, the medium 99 passes smoothly the junction A1, because the flap 19 is moved to the first position B1 by the driving force of the driving section 18. In other words, the medium 99 traveling downstream along the first transportation path 24 does not need to push the flap 19 when passes the junction A1. This reduces the possibility that the medium 99 will be stuck.

(2) The flap 19 is pushed by the displacement member 53 to the first position B1. In this configuration, the flap 19 is moved to the first position B1 by the simple structure.

(3) The second discharge roller 34 is rotated by a driving force of the driving section 18. In other words, the second discharge roller 34 and the displacement member 53 are driven by the same driving section 18. In this configuration, the structure of the recording device 11 is simpler than that including different driving sections 18 for the second discharge roller 34 and the displacement member 53.

(4) The displacement member 53 is moved by rotation of the support shaft 56. When the driving section 18 rotates the second discharge roller 34 to send the medium 99 downstream along the first transportation path 24, the displacement member 53 is moved by the driving force of the driving section 18 to push the flap 19 toward the first position B1. In this configuration, the flap 19 is moved to the first position B1 when the second discharge roller 34 is rotated to send the medium 99 downstream along the first transportation path 24. This allows the medium 99 traveling downstream along the first transportation path 24 to pass smoothly the junction A1.

(5) When the driving section 18 rotates the second discharge roller 34 to send the medium 99 upstream along the first transportation path 24, the displacement member 53 is moved by the driving force of the driving section 18 to be away from the flap 19. In this configuration, the flap 19 is moved to the second position B2 by the force of the spring 47 when the second discharge roller 34 rotates to send the medium 99 upstream along the first transportation path 24. This allows the medium 99 traveling upstream along the first transportation path 24 to be guided to the second transportation path 25.

(6) The flap 19 is pushed toward the second position B2 by the spring 47. In this configuration, if the medium 99 transported has high rigidity, the medium 99 is able to push the flap 19 to the first position B1. In such a case, the second discharge roller 34 may be rotated in a second direction to send the medium 99 along the second transportation path 25 while the first discharge roller 33 is rotated in a first direction to send the next medium 99 to the downstream section 44. This increases the speed of handling the medium 99 in the recording device 11.

The embodiment may be modified as below. The embodiment and the following modifications may be combined without creating technical inconsistency.

The junction A1 may be located upstream of the recording unit 14 on the first transportation path 24.

The meeting point A2 may be located downstream of the junction A1 on the first transportation path 24.

The second transportation path 25 is not required to be joined to the first transportation path 24 and may be joined to a path different from the first transportation path 24 or a device different from the recording device 11.

The recording device 11 may include a driving section that drives the flap 19 in addition to the driving section 18. In such a case, the flap 19 is movable independently of the rotation of the second discharge roller 34.

The driving section 18 used to move the flap 19 is not limited to the driving section that rotates the second discharge roller 34 and may be a driving section that rotates a roller different from the second discharge roller 34. Furthermore, the flap 19 may be moved by a driving force of a driving section for a component other than the transportation unit 17.

The displacement member 53 may push the flap 19 not only to the first position B1 but also to the second position B2. In such a case, the arm 64 may hold the front end of the contact portion 45.

The flap 19 may be moved to the second position B2 by the driving force of the driving section 18. In such a case, the spring 47 may be eliminated.

The flap 19 may be directly moved by the driving force of the driving section 18. For example, the driving section 18 may be coupled to the rotation shaft 37.

The displacement member 53 at the pushing position C1 may be moved to the retracted position C2 while being in contact with the flap 19. In such a case, the flap 19 is less vibrated when moved from the first position B1 to the second position B2.

The housing 13 may directly accommodate the medium 99 without the cassette 21.

The recording unit 14 is not limited to the ink jet recording unit and may be an electrophotographic recording unit, which applies solid toner particles and then fixes an image on the medium 99 by using a photoreceptor.

The liquid ejected from the head 22 is not limited to an ink and may be a liquid state material including particles of functional material dispersed or mixed in a liquid. For example, the head 22 may eject a liquid state material including a dispersed or dissolved electrode material or pixel material, which are used in the production of a liquid crystal display, an electroluminescence display, and a surface emitting display.

Hereinafter, technical ideas understood from the above-described embodiment and modifications, and operation and effects thereof are described.

(A) A recording device includes a first transportation path along which a medium is transported, a recording unit configured to record on the medium on the first transportation path, a second transportation path branching from the first transportation path, a flap located at a junction of the first transportation path and the second transportation path and configured to be moved to a first position to open the first transportation path and to a second position to close the first transportation path, and a driving section. After the medium passes the junction, the flap is positioned at the second position to come in contact with the medium traveling upstream along the first transportation path and guide the medium to the second transportation path. The flap is moved to the first position by a driving force of the driving section.

In this configuration, when the medium travels downstream along the first transportation path, the medium passes smoothly the junction, because the flap is moved to the first position by the driving force of the driving section. In other words, the medium traveling downstream along the first transportation path does not need to push the flap when passes the junction. This reduces the possibility that the medium will be stuck.

(B) The recording device may include a displacement member configured to be moved by a driving force of the driving section. The flap may be pushed by the displacement member to the first position.

In this configuration, the flap is moved to the first position by the simple structure.

(C) The recording device may include a transportation unit configured to transport the medium along the first transportation path and the second transportation path. The junction may be located downstream of the recording unit on the first transportation path. The transportation unit may include a first discharge roller at a position between the recording unit and the junction on the first transportation path and a second discharge roller located downstream of the junction on the first transportation path. The second discharge roller may be rotated by a driving force of the driving section.

In this configuration, the structure of the recording device is simpler than that including different driving sections for the second discharge roller and the displacement member.

(D) The recording device may include a first gear disposed on a shaft of the second discharge roller and configured to be rotated by rotation of the second discharge roller, a second gear meshed with the first gear, and a support shaft supporting the second gear and the displacement member and configured to be rotated by rotation of the second gear. The displacement member may be moved by rotation of the support shaft. When the driving section rotates the second discharge roller to send the medium downstream along the first transportation path, the displacement member may be moved by the driving force of the driving section to push the flap toward the first position.

In this configuration, the flap is moved to the first position when the second discharge roller is rotated to send the medium downstream along the first transportation path. This allows the medium traveling downstream along the first transportation path to pass smoothly the junction.

(E) The recording device may include a spring configured to push the flap toward the second position. When the driving section rotates the second discharge roller to send the medium upstream along the first transportation path, the displacement member may be moved by the driving force of the driving section to be away from the flap.

In this configuration, the flap is moved to the second position by the force of the spring when the second discharge roller rotates to send the medium upstream along the first transportation path. This allows the medium traveling upstream along the first transportation path to be guided to the second transportation path.

What is claimed is:

1. A recording device comprising:

a first transportation path along which a medium is transported;

a recording unit configured to record on the medium on the first transportation path;

a second transportation path branching from the first transportation path;

a transportation unit configured to transport the medium along the first transportation path and the second transportation path;

a flap located at a junction of the first transportation path and the second transportation path and configured to be moved to a first position to open the first transportation path and to a second position to close the first transportation path;

a driving section configured to drive the transportation unit; and a power transmission unit configured to transmit power of the transportation unit to the flap, wherein after the medium passes the junction, the flap is positioned at the second position to come in contact with the medium traveling upstream along the first transportation path and guide the medium to the second transportation path, and the flap is moved to the first position by transmission of the power of the transportation unit through the power transmission unit.

2. The recording device according to claim 1, wherein the junction is located downstream of the recording unit on the first transportation path, the transportation unit includes a discharge roller located downstream of the junction on the first transportation path, the discharge roller is configured to be rotated by a driving force of the driving section, and the flap is configured to be moved to the first position by transmission of the power of the transportation unit through the power transmission unit.

3. The recording device according to claim 2, wherein:

the transmission unit includes a displacement member configured to be moved in conjunction with rotation of the discharge roller, wherein the flap is pushed by the displacement member to the first position.

4. The recording device according to claim 3, further comprising:

a first gear disposed on a shaft of the discharge roller and configured to be rotated by rotation of the discharge roller;

a second gear meshed with the first gear; and a support shaft supporting the second gear and the displacement member and configured to be rotated by rotation of the second gear, wherein the displacement member is moved by rotation of the support shaft, when the driving section rotates the discharge roller to send the medium downstream along the first transportation path, the displacement member is moved by the driving force of the driving section to push the flap toward the first position.

5. The recording device according to claim 4, further comprising a spring configured to push the flap toward the second position, wherein when the driving section rotates the discharge roller to send the medium upstream along the first transportation path, the displacement member is moved by the driving force of the driving section to be away from the flap.

6. The recording device according to claim 2, wherein when the driving section rotates the discharge roller to send the medium downstream along the first transportation path, the flap is moved to the first position, and when the driving section rotates the discharge roller to send the medium upstream along the first transportation path, the flap is moved to the second position.

7. The recording device according to claim 1, wherein when the driving section rotates the discharge roller to send the medium upstream along the first transportation path, the displacement member is moved by the driving force of the driving section to be away from the flap.

8. A recording device comprising:

a first transportation path along which a medium is transported;

a recording unit configured to record on the medium on the first transportation path;

a second transportation path branching from the first transportation path;

a flap located at a junction of the first transportation path and the second transportation path and configured to be moved to a first position to open the first transportation path and to a second position to close the first transportation path;

a driving section;

a displacement member configured to be moved by a driving force of the driving section, wherein the flap is pushed by the displacement member to the first position;

a transportation unit configured to transport the medium along the first transportation path and the second transportation path, wherein the junction is located downstream of the recording unit on the first transportation path, the transportation unit includes a first discharge roller at a position between the recording unit and the junction on the first transportation path and a second discharge roller located downstream of the junction on the first transportation path, and the second discharge roller is rotated by a driving force of the driving section;

a first gear disposed on a shaft of the second discharge roller and configured to be rotated by rotation of the second discharge roller;

a second gear meshed with the first gear; and a support shaft supporting the second gear and the displacement member and configured to be rotated by rotation of the second gear, wherein after the medium passes the junction, the flap is positioned at the second position to come in contact with the medium traveling upstream along the first transportation path and guide the medium to the second transportation path, the flap being moved to the first position by the driving force of the driving section, and the displacement member is moved by rotation of the support shaft, when the driving section rotates the second discharge roller to send the medium downstream along the first transportation path, the displacement member is moved by the driving force of the driving section to push the flap toward the first position.

9. The recording device according to claim 8, further comprising a spring configured to push the flap toward the second position, wherein when the driving section rotates the second discharge roller to send the medium upstream along the first transportation path, the displacement member is moved by the driving force of the driving section to be away from the flap.

10. A recording device comprising:

a first transportation path along which a medium is transported;

a recording unit configured to record on the medium on the first transportation path;

a second transportation path branching from the first transportation path;

a transportation unit configured to transport the medium along the first transportation path and the second transportation path;

a flap located at a junction of the first transportation path and the second transportation path and configured to be moved to a first position to open the first transportation path and to a second position to close the first transportation path, the junction is located downstream of the recording unit on the first transportation path, the transportation unit includes a discharge roller located downstream of the junction on the first transportation path; and a driving section configured to drive the transportation unit, the discharge roller being configured to be rotated by a driving force of the driving section, wherein after the medium passes the junction, the flap is positioned at the second position to come in contact with the medium traveling upstream along the first transportation path and guide the medium to the second transportation path, the flap is moved to the first position in conjunction with an operation of the transportation unit and in conjunction with rotation of the discharge roller, when the driving section rotates the discharge roller to send the medium downstream along the first transportation path, the flap is moved to the first position, and when the driving section rotates the discharge roller to send the medium upstream along the first transportation path, the flap is moved to the second position.

11. The recording device according to claim 10, further comprising:

a first gear disposed on a shaft of the discharge roller and configured to be rotated by rotation of the discharge roller;

a second gear meshed with the first gear; and a support shaft supporting the second gear and the displacement member and configured to be rotated by rotation of the second gear, wherein the displacement member is moved by rotation of the support shaft, when the driving section rotates the discharge roller to send the medium downstream along the first transportation path, the displacement member is moved by the driving force of the driving section to push the flap toward the first position.

12. The recording device according to claim 10, further comprising a spring configured to push the flap toward the second position, wherein when the driving section rotates the discharge roller to send the medium upstream along the first transportation path, the displacement member is moved by the driving force of the driving section to be away from the flap.

* * * * *